US011815295B2

(12) United States Patent
Durand et al.

(10) Patent No.: US 11,815,295 B2
(45) Date of Patent: Nov. 14, 2023

(54) REFRIGERATION DEVICE AND FACILITY

(71) Applicant: L'Air Liquide, Societe Anonyme pour l'Etude et l'Exploitation des Procedes Georges Claude, Paris (FR)

(72) Inventors: Fabien Durand, Sassenage (FR); Guillaume Delautre, Sassenage (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 90 days.

(21) Appl. No.: 17/633,095

(22) PCT Filed: Jul. 8, 2020

(86) PCT No.: PCT/EP2020/069174
§ 371 (c)(1),
(2) Date: Feb. 4, 2022

(87) PCT Pub. No.: WO2021/023455
PCT Pub. Date: Feb. 11, 2021

(65) Prior Publication Data

US 2022/0333828 A1 Oct. 20, 2022

(30) Foreign Application Priority Data

Aug. 5, 2019 (FR) ..... 1908948

(51) Int. Cl.
*F25B 1/053* (2006.01)
*F25B 1/10* (2006.01)
(Continued)

(52) U.S. Cl.
CPC ..... *F25B 1/053* (2013.01); *F25B 1/10* (2013.01); *F25B 9/06* (2013.01); *F25B 11/04* (2013.01);
(Continued)

(58) Field of Classification Search
CPC ..... F25J 1/0259; F25J 1/0261; F25J 1/0262; F25J 5/002; F25D 23/006; F17C 2265/034; F25B 9/06
See application file for complete search history.

(56) References Cited

U.S. PATENT DOCUMENTS 3,213,632 A * 10/1965 Valk ..... F17C 3/025 62/53.2
5,385,203 A * 1/1995 Mitsuhashi ..... B01D 5/0036 165/145
(Continued)

FOREIGN PATENT DOCUMENTS

WO WO 2019/073129 4/2019

OTHER PUBLICATIONS

International Search Report and Written Report for PCT/EP2020/069174, dated Oct. 16, 2020.
(Continued)

*Primary Examiner* — Christopher R Zerphey
(74) *Attorney, Agent, or Firm* — Justin K. Murray

(57) ABSTRACT

Low-temperature refrigeration device arranged in a frame and comprising a working circuit forming a loop and containing a working fluid, the working circuit forming a cycle comprising in series: a compression mechanism, a cooling mechanism, an expansion mechanism and a heating mechanism, the device comprising a refrigeration heat exchanger intended to extract heat from at least one member by exchanging heat with the working fluid, the mechanisms for cooling and reheating the working fluid comprising a common heat exchanger in which the working fluid transits in counter-flow in two separate transit portions of the working circuit, the compression mechanism comprising at least two compressors and at least one motor for driving the compressors, the working fluid expansion mechanism comprising at least one rotary turbine, the device comprising at least one
(Continued)

drive motor comprising a drive shaft, one end of which drives a compressor and the other end of which is coupled to a turbine, the motor being attached to the frame at at least one fixed point, the common heat exchanger being attached to the frame at at least one fixed point, the two counter-flow transit portions of the common heat exchanger being orientated in a longitudinal direction of the frame, the drive shaft of the drive motor being orientated in a direction parallel or substantially parallel to the longitudinal direction and the turbine and the compressor being arranged relatively longitudinally such that the turbine is located longitudinally on the side corresponding to the relatively cold end of the common heat exchanger when the device is being operated and the compressor is located longitudinally on the side corresponding to the relatively hot end of the common heat exchanger when the device is being operated.

14 Claims, 2 Drawing Sheets

(51) Int. Cl.

| | |
|---|---|
| ***F25B 9/06*** | (2006.01) |
| ***F25B 11/04*** | (2006.01) |
| ***F25B 31/02*** | (2006.01) |
| ***F25J 1/00*** | (2006.01) |
| ***F25J 1/02*** | (2006.01) |

(52) U.S. Cl.
CPC ..... *F25B 31/026* (2013.01); *F25J 1/005* (2013.01); *F25J 1/0025* (2013.01); *F25J 1/0204* (2013.01); *F25J 1/0259* (2013.01); *F25J 1/0261* (2013.01); *F25J 1/0288* (2013.01); *F25J 1/0296* (2013.01); *F25B 2400/054* (2013.01); *F25B 2400/072* (2013.01); *F25B 2500/01* (2013.01)

(56) References Cited

U.S. PATENT DOCUMENTS

| | | | | |
|---|---|---|---|---|
| 7,637,112 | B2 * | 12/2009 | Vanden Bussche ... | F25J 1/0262 62/903 |
| 8,739,569 | B2 * | 6/2014 | Oka ..... | F25J 1/0052 62/53.2 |
| 10,097,067 | B2 * | 10/2018 | Inoue ..... | H02K 7/1823 |
| 11,187,467 | B2 * | 11/2021 | Voda ..... | F25J 1/0258 |
| 11,408,648 | B2 * | 8/2022 | Durand ..... | F25B 9/14 |
| 2012/0291434 | A1 | 11/2012 | Janssens | |
| 2016/0164378 | A1 * | 6/2016 | Gauthier ..... | H02K 5/203 310/54 |
| 2018/0087809 | A1 | 3/2018 | Ueda et al. | |
| 2020/0300510 | A1 | 9/2020 | Durand | |

OTHER PUBLICATIONS

FR Search Report for FR 1 908 948, dated Apr. 3, 2020.
"Brayton Closed Cycle Gas Turbine Study for LNG Reliquefaction System," Shipping World & Shipbuilder, vol. 166, No. 3887, Nov. 1, 1973, pp. 1199-1200.

* cited by examiner

[Fig. 1]
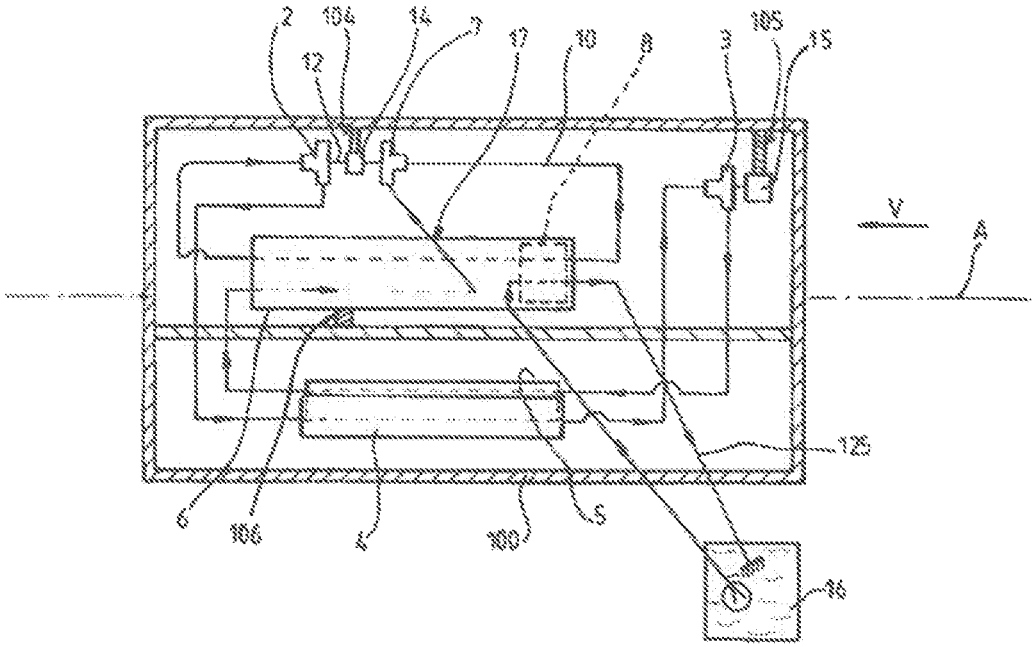
[Fig. 2]
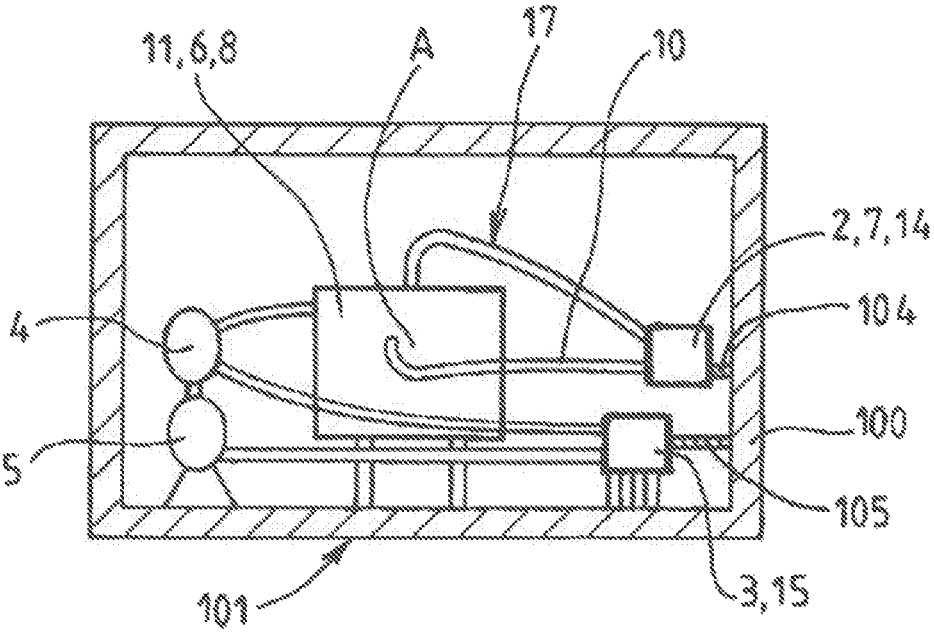

[Fig. 3]
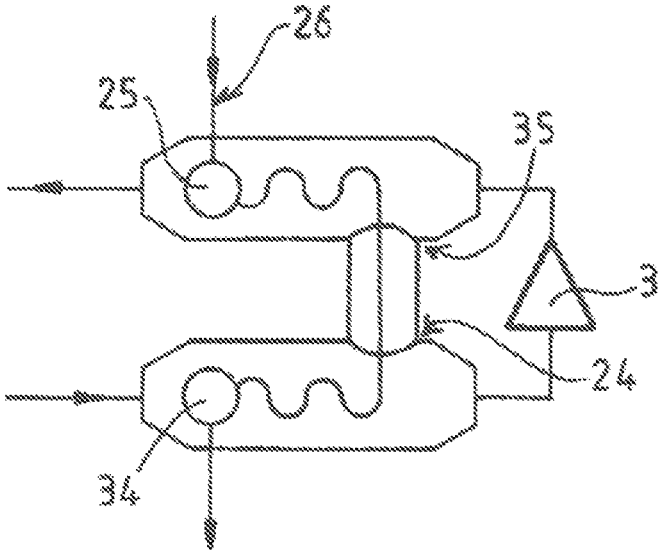

REFRIGERATION DEVICE AND FACILITY

CROSS-REFERENCE TO RELATED APPLICATIONS

This application is a § 371 of International PCT Application PCT/EP2020/069174, filed Jul. 8, 2020, which claims § 119(a) foreign priority to French patent application FR 1908948, filed Aug. 5, 2019.

BACKGROUND

Field of the Invention

The invention relates to a device and a system for refrigeration.

The invention relates more particularly to a low-temperature refrigeration device, that is to say for refrigeration at a temperature of between minus 100 degrees centigrade and minus 273 degrees centigrade, the device being disposed in a frame and comprising a working circuit forming a loop and containing a working fluid, the working circuit forming a cycle that comprises, in series: a mechanism for compressing the working fluid, a mechanism for cooling the working fluid, a mechanism for expanding the working fluid, and a mechanism for heating the working fluid, the device comprising a refrigeration heat exchanger intended to extract heat at at least one member by heat exchange with the working fluid circulating in the working circuit, the mechanisms for cooling and heating the working fluid comprising a common heat exchanger through which the working fluid passes in countercurrent in two separate passage portions of the working circuit depending on whether it is cooled or heated, the compression mechanism comprising at least two compressors and at least one drive motor for the compressors, the mechanism for expanding the working fluid comprising at least one rotary turbine, the device comprising at least one drive motor comprising a drive shaft, one end of which drives at least one compressor and another end of which is coupled to a turbine, said motor being fixed to the frame at at least one fixed point, the common heat exchanger being fixed to the frame at at least one fixed point, the two countercurrent passage portions of the common heat exchanger being oriented in a longitudinal direction of the frame.

Related Art

The term low-temperature refrigeration device denotes devices for refrigeration at a temperature of between minus 100 degrees centigrade and minus 273 degrees centigrade, in particular between minus 100 degrees centigrade and minus 253 degrees centigrade.

The invention relates in particular to cryogenic refrigerators and/or liquefiers, for example of the type having a "Turbo Brayton" cycle or "Turbo Brayton coolers" in which a working gas, also known as a cycle gas (helium, nitrogen, hydrogen or another pure gas or a mixture), undergoes a thermodynamic cycle producing cold which can be transferred to a member or a gas intended to be cooled.

These devices are used in a wide variety of applications and in particular for cooling natural gas in a tank (for example in ships). The liquefied natural gas is for example subcooled to avoid vaporization thereof or the gaseous part is cooled in order to be reliquefied.

For example, a flow of natural gas can be made to circulate in a heat exchanger cooled by the cycle gas of the refrigerator/liquefier.

These devices may comprise a plurality of heat exchangers interposed at the outlets of the compression stages. These devices are incorporated in a frame or surround, the volume of which is limited. It is thus difficult to incorporate these various exchangers and associated pipes. The cooling of the working gas may be problematic in some cases.

In addition, the various components of the device may be subject to significant temperature variations between ambient temperature and cryogenic temperatures (in particular down to 25K). Thus, these temperature variations are likely to cause dimensional variations which may have a negative effect on the integrity of the device.

SUMMARY OF THE INVENTION

An aim of the present invention is to overcome all or some of the drawbacks of the prior art that are set out above.

To this end, the device according to the invention, which is otherwise in accordance with the generic definition thereof given in the above preamble, is essentially characterized in that the drive shaft of said drive motor is oriented in a direction parallel or substantially parallel to the longitudinal direction, the turbine and the compressor being arranged longitudinally relative to one another such that the turbine is situated longitudinally on the side corresponding to the relatively cold end of the common heat exchanger when the device is in operation and the compressor is situated longitudinally on the side corresponding to the relatively hot end of the common heat exchanger when the device is in operation.

Furthermore, embodiments of the invention may include one or more of the following features:

- the connection of the common heat exchanger to the fixed point of the frame is situated at a longitudinal position of the heat exchanger that is situated between the relatively hot and cold ends thereof when the device is in operation, and in particular in the portion of the heat exchanger separating the cold end of the heat exchanger, which is likely to contract, and the hot end of the heat exchanger, which is likely to expand,
- when the device is in operation, the temperature of the common heat exchanger varies longitudinally between a cold end and a hot end, the cold end, in particular at a temperature of around 100K, receiving the relatively cold working fluid coming from the expansion mechanism in order to heat it and evacuating the cooled working fluid before it enters the expansion mechanism, the hot end, in particular at a temperature of around 300K, receiving the hot working fluid coming from the compression mechanism and evacuating the heated working fluid before it enters the compression mechanism, the connection of the common heat exchanger to the fixed point of the frame being situated at an intermediate longitudinal position of the heat exchanger between the cold and hot ends thereof, in particular in a zone at an operating temperature of between 200 and 270 K, in particular 250 K,
- the fixed points for fixing the motor and the common heat exchanger, respectively, to the frame are spaced apart in the longitudinal direction (A) by a distance less than 100 cm, in particular less than 50 cm, and are preferably situated at the same level in the longitudinal direction of the frame, the mechanism for cooling the working fluid comprises two cooling heat exchangers that are disposed respectively at the outlets of the two compressors and ensure heat exchange between the working fluid and a cooling fluid, the frame comprising a lower base intended to be fixed to a support, the two cooling heat exchangers being situated in the frame next to the common heat exchanger in a direction transverse to the longitudinal axis, meaning that the cooling heat exchangers are not situated between the common heat exchanger and the lower base of the frame, the two cooling heat exchangers each have an elongate shape extending in respective longitudinal directions that are parallel to the longitudinal axis, the two cooling heat exchangers are disposed one above the other in a perpendicular direction, each cooling heat exchanger comprises an inlet for working gas to be cooled and an outlet for cooled working gas that are disposed respectively at two longitudinal ends, each cooling heat exchanger comprising an inlet for cooling fluid and an outlet for cooling fluid, the two cooling heat exchangers being arranged inversely with respect to one another, meaning that the respective longitudinal directions of the two cooling heat exchangers are parallel or substantially parallel and the directions of circulation of the working fluid in said cooling heat exchangers are opposite to one another, the outlet for cooling fluid of one of the two cooling heat exchangers is connected to the inlet for cooling fluid of the other cooling heat exchanger such that some of the flow of cooling fluid passing through one of the cooling heat exchangers has already circulated in the other cooling heat exchanger, the two cooling heat exchangers are situated adjacently, that is to say in a manner spaced apart by a distance of between 50 and 500 mm, in particular between 10 and 300 mm.

The invention also relates to a system for refrigeration and/or liquefaction of a flow of user fluid, in particular natural gas, comprising a refrigeration device according to any one of the features above or below, the system comprising at least one tank of user fluid, and a duct for circulation of said flow of user fluid in the cooling exchanger.

The invention may also relate to any alternative device or method comprising any combination of the features above or below within the scope of the claims.

BRIEF DESCRIPTION OF THE FIGURES

Further particular features and advantages will become apparent upon reading the following description, which is given with reference to the figures, in which:

FIG. 1 shows a schematic and partial top view illustrating the structure and operation of an example of a device and a system that can implement the invention, FIG. 2 shows a schematic and partial side view along the arrow V in FIG. 1 illustrating details of the structure and of the operation of the device and of the system, FIG. 3 shows a schematic and partial view illustrating a detail of the structure and of the operation of the device and of the system according to one possible embodiment variant of the arrangement of two cooling heat exchangers.

DETAILED DESCRIPTION OF THE INVENTION

The cooling and/or liquefaction system in [FIG. 1] and [FIG. 2] comprises a refrigeration device 1 that supplies cold (a cooling capacity) at a cooling heat exchanger 8.

The system comprises a duct 125 for circulation of a flow of fluid to be cooled placed in heat exchange with this cooling exchanger 8. For example, the fluid is liquid natural gas pumped from a tank 16 (for example via a pump), then cooled (preferably outside the tank 16), then returned to the tank (for example raining down in the gas phase of the tank 16). This makes it possible to cool or subcool the contents of the tank 16 and to limit the occurrence of vaporization. For example, the liquid from the tank 16 is subcooled below its saturation temperature (drop in its temperature of several K, in particular 5 to 20K and in particular 14K) before being reinjected into the tank 16. In a variant, this refrigeration can be applied to the vaporization gas from the tank in order in particular to reliquefy it. This means that the refrigeration device 1 produces a cold capacity at the refrigeration heat exchanger 8.

The refrigeration device 1 comprises a working circuit 10 (preferably closed) forming a circulation loop. This working circuit 10 contains a working fluid (helium, nitrogen, neon, hydrogen or another appropriate gas or mixture, for example helium and argon or helium and nitrogen or helium and neon or helium and argon and nitrogen or helium and nitrogen and argon or helium and neon and argon or helium and nitrogen and argon and neon, etc.).

The working circuit 10 forms a cycle comprising: a mechanism 2, 3 for compressing the working fluid, a mechanism 4, 5, 6 for cooling the working fluid, a mechanism 7 for expanding the working fluid, and a mechanism 6 for heating the working fluid.

The device 1 comprises a refrigeration heat exchanger 8 situated downstream of the expansion mechanism 7 and intended to extract heat at at least one member 25 by heat exchange with the cold working fluid circulating in the working circuit 10.

The mechanisms for cooling and heating the working fluid conventionally comprise a common heat exchanger 6 through which the working fluid passes in countercurrent in two separate passage portions of the working circuit 10 depending on whether it is cooled or heated in the cycle.

The cooling heat exchanger 8 is situated for example between the expansion mechanism 7 and the common heat exchanger 6. As illustrated, this refrigeration heat exchanger 8 may be incorporated into the common heat exchanger 6 (meaning that the two exchangers 6, 8 can be in one piece, i.e. may have separate fluid circuits that share one and the same exchange structure). Of course, in a variant, the cooling heat exchanger 8 may be a heat exchanger separate from the common heat exchanger 6.

Thus, the working fluid which leaves the compression mechanism 2, 3 in a relatively hot state is cooled in the common heat exchanger 6 before entering the expansion mechanism 7. The working fluid which leaves the expansion mechanism 7 and the cooling heat exchanger 8 in a relatively cold state is, for its part, heated in the common heat exchanger 6 before returning into the compression mechanism 2, 3 in order to start a new cycle.

The compression mechanism 2, 3 may comprise at least two compressors and at least one drive motor 14, 15 for the compressors 2, 3. In addition, preferably, the refrigeration capacity of the device is variable and can be controlled by regulating the speed of rotation of the drive motor(s) 14, 15 (cycle speed). Preferably, the cold capacity produced by the device 1 can be adapted by 0 to 100% of a nominal or maximum capacity by changing the speed of rotation of the motor(s) 14, 15 between a zero speed of rotation and a maximum or nominal speed. Such an architecture makes it possible to maintain a high performance level over a wide operating range (for example 97% of nominal performance at 50% of the nominal cold capacity).

In the nonlimiting example shown, the refrigeration device 1 comprises two compressors 2, 3 in series. These two compressors 2, 3 may be driven respectively by two separate motors 14, 15. A turbine 7 is coupled to the drive shaft of one 14 of the two motors. For example, a first motor 14 drives a compressor 2 and is coupled to a turbine 7 (motor-turbocompressor) while the other motor 15 drives only a compressor 3 (motor-compressor). The order of this motor-turbocompressor and this motor-compressor may be reversed in the working circuit 10 (meaning that the first compressor in series may be driven by a motor, the shaft of which is not coupled to a turbine while the second compressor in series is driven by a motor, the shaft of which is also coupled to a turbine).

For example, the device 1 comprises two high-speed motors 14, 15 (for example 10 000 revolutions per minute or several tens of thousands of revolutions per minute) for respectively driving the compression stages 2, 3. The turbine 7 may be coupled to the motor 15 of one of the compression stages 2, 3, meaning that the device may have a turbine 7 forming the expansion mechanism which is coupled to the drive motor 15 of a compression stage (the first or the second).

Thus, the power of the turbine(s) 7 can advantageously be recovered and used to reduce the consumption of the motor (s). Thus, by increasing the speed of the motors (and thus the flow rate in the cycle of the working gas), the refrigeration capacity produced and thus the electrical consumption of the liquefier are increased (and vice versa). The compressors 2, 3 and turbine(s) 7 are preferably coupled directly to an output shaft of the motor in question (without a geared movement transmission mechanism).

The output shafts of the motors are preferably mounted on bearings of the magnetic type or of the dynamic gas type. The bearings are used to support the compressors and the turbines.

In the example depicted, the refrigeration device 1 comprises two compressors 2, 3 that form two compression stages and an expansion turbine 7. This means that the compression mechanism comprises two compressors 2, 3 in series, preferably of the centrifugal type, and the expansion mechanism comprises a single turbine 7, preferably a centripetal turbine. Of course, any other number and arrangement of compressor(s), turbine(s) and motor(s) may be envisioned, for example: three compressors driven respectively by three separate motors, the turbine being for example coupled to one end of the drive shaft of one of these motors or three compressors and two turbines, etc. Other architectures may be envisioned, in particular three compressors and one turbine or three compressors or two or three turbines or two compressors and two turbines, etc. Each motor may have a rotary drive shaft, one end of which drives a compressor and optionally another wheel, and the other end of which is free (no wheel mounted on the end) or optionally drives at least one other wheel (compressor or turbine).

As illustrated, a cooling heat exchanger 4, 5 may be provided at the outlet of each of the two compressors 2, 3 (for example cooling by heat exchange with water at ambient temperature or any other cooling agent or fluid of a coolant circuit 26). Cf. [FIG. 2].

This makes it possible to realize isentropic or isothermal or substantially isothermal compression. Similarly, a heating exchanger may or may not be provided at the outlet of all or part of the expansion turbines 7 to realize isentropic or isothermal expansion. Also preferably, the heating and cooling of the working fluid are preferably isobaric, without this being limiting.

The device is housed in a frame 100, for example a parallelepipedal frame. The frame 100 comprises a lower base 101. In contrast to the depiction in FIG. 2, the upper end of the frame does not necessarily have a structure above the device but could have only peripheral struts which are situated vertically above the base 101 at or below the highest point of the device. This means that the frame may form lateral protection all around the device, but leaving the upper part uncovered.

The motor 14 provided with a compressor 2 and with a turbine is fixed to the frame 100 at a fixed point 104. For example, the frame 100 comprises a surround or structure that is parallelepipedal and formed of rigid struts or beams. For example, this motor 14 is fixed to a peripheral longitudinal strut, for example by screwing and/or riveting and/or welding.

Similarly, the common heat exchanger 6 is fixed to the frame 100 at a fixed point 106. For example, this heat exchanger 6 is fixed to a central longitudinal strut for example by screwing and/or riveting and/or welding.

The two countercurrent passage portions of the common heat exchanger 6 are oriented in a longitudinal direction A of the frame 100. This means that the common heat exchanger 6 is oriented in a longitudinal direction A and the flows of working gas within it pass substantially parallel in this direction.

As can be seen in [FIG. 1], the drive shaft of the motor 14, 15 provided with a compressor 2 and with a turbine 7 is also oriented in a direction parallel or substantially parallel to this longitudinal direction A.

Moreover, the turbine 7 and the compressor 2 are arranged relatively longitudinally such that the turbine 7 is situated longitudinally on the side corresponding to the relatively cold end of the common heat exchanger 6 when the device is in operation (on the right in [FIG. 1]) and the compressor 2 is situated longitudinally on the side corresponding to the relatively hot end of the common heat exchanger 6 when the device is in operation (on the left in [FIG. 1]).

This makes it possible:

to dispose on one and the same side of the device (in this case longitudinal and on the right in [FIG. 1]) the elements (portion of exchanger 6, turbine 7 and associated pipes) that are likely to undergo dimensional retractions on passing from the hot operating state to the cold operating state, to dispose on one and the same side of the device (in this case longitudinal and on the left in [FIG. 1]) the elements (portion of exchanger 6, compressor 2 and associated pipes) that are likely to undergo dimensional retractions on passing from the hot operating state.

These elements situated on either side of the fixed fixing point 104, 105 may thus be free to retract/expand without constraint.

The "cold" elements (turbine 7, cold end of the exchanger and associated pipes) are free to contract in the same direction (to the left in [FIG. 1]). The "hot" elements (compressor 2, hot end of the heat exchanger 6 and associated pipes) are free to expand in the same direction (likewise to the left in [FIG. 1]). This makes it possible to avoid or limit unwanted forces on the device, which takes up better the dimensional variations caused by the changes in temperature within it.

Specifically, conventionally when the device is in operation (in particular in nominal operation), the temperature of the heat exchanger 6 is equalized along a longitudinal gradient between a cold end and a hot end. The cold end, for example at a temperature of around 100K, is the end of the heat exchanger 6 that receives the relatively cold working fluid coming from the expansion mechanism 7 in order to heat it and evacuates, in the other direction, the cooled working fluid before it enters the expansion mechanism 7. The hot end, for example at a temperature of around 300K, is the end of the common heat exchanger 6 that receives the hot working fluid coming from the compression mechanism and evacuates, in the other direction, the heated working fluid before it enters the compression mechanism.

According to an advantageous particular feature, the connection of the common heat exchanger 6 to the fixed point 106 of the frame 100 is situated at an intermediate longitudinal position of the heat exchanger 6 between the cold and hot ends thereof, in particular in a zone at an operating temperature of between 200 and 270 K, in particular 250K.

Preferably, the connection of the common heat exchanger 6 to the fixed point of the frame 100 is situated at a longitudinal position of the heat exchanger 6 that is situated between the relatively hot and cold ends thereof when the device is in operation, and in particular in the portion of the heat exchanger 6 separating the cold end of the heat exchanger 6, which is likely to contract (differential contraction caused by cooling to low temperatures), and the hot end of the heat exchanger 6, which is likely to expand (differential expansion caused by relative heating to higher temperatures).

This allows the cold parts of the common heat exchanger 6 and the associated cold pipes to retract freely (toward the left in the example in [FIG. 1]) and the hot parts to expand freely (to the left in the example in [FIG. 1]).

This reduces the detrimental mechanical stresses within the device.

Preferably, the fixed points 104, 106 for fixing the motor 14 and the common heat exchanger 6, respectively, to the frame 100 are situated at the same longitudinal level on the frame or spaced apart in this longitudinal direction A by a distance less than 100 cm, in particular less than 50 cm.

By arranging the fixed points in this way, the fold elements, which are likely to contract, for the one part, and the relatively hot elements, which are likely to expand, for the other part, are positioned relative to one another so as to allow travels of the same kind without causing, or limiting, contradictory counter-acting opposing forces.

The frame 100 comprises a lower base 101 intended to be fixed to a support (for example the ground or a floor of a ship or the top of a tank 16 of liquid to be cooled for example). This base may be formed of rigid struts that delimit a rectangle provided with longitudinal or transverse struts.

As illustrated in [FIG. 1], at least a part of the elements of the device may be fixed to this base 101, in particular a box structure accommodating the common heat exchanger 6 and the refrigeration exchanger 8.

The two cooling heat exchangers 4, 5 may be disposed in the frame 100 next to the common heat exchanger 6 in a direction transverse to the longitudinal axis A. This means that the cooling heat exchangers 4, 5 are not situated between the common heat exchanger 6 and the lower base 101 of the frame 100. The inventors have found that this arrangement ensures a distribution of the masses that improves the integrity of the device with respect to forces in particular when the device is mounted on a ship.

As illustrated, the two cooling heat exchangers 4, 5 may each have an elongate shape extending in respective longitudinal directions that are parallel to the longitudinal axis A. The two cooling heat exchangers 4, 5 may be disposed one above the other in a perpendicular direction.

Each cooling heat exchanger 4, 5 comprises an inlet 24, 25 for cooling fluid and an outlet 34, 35 for cooling fluid. According to an advantageous particular feature, the outlet 34 for cooling fluid of one of the two cooling heat exchangers 4, 5 may be connected to the inlet 25 for cooling fluid of the other cooling heat exchanger 5 such that some of the flow of cooling fluid passing through one 5 of the cooling heat exchangers has already circulated in the other cooling heat exchanger 4 (cf. [FIG. 3]).

This allows the two cooling heat exchangers 4, 5 to receive 100% of a flow of cooling fluid (rather than subdividing this flow into two halves distributed respectively in the two exchangers 4, 5).

This relative increase in the cooling fluid flow rate thus makes it possible to increase the coefficient of heat exchange and therefore improves the quality and the reliability of cooling. Moreover, this solution makes it possible to avoid problems inherent to the known solution in which two flow rates can diverge within the two heat exchangers (on account in particular of pressure drops which may vary from one circuit or exchanger to the other).

As explained in more detail below, this arrangement also makes it possible to simplify the network of ducts for cooling fluid and working gas heading toward the heat exchangers 4, 5 or coming from the heat exchangers 4, 5. In particular, this arrangement makes it more easily possible to arrange the circulation circuits for the fluids (cooling fluid and working fluid) in a smaller space while allowing countercurrent circulations between the working fluid and the cooling fluid, by reducing the number and/or the length of the ducts transporting these fluids.

As shown in [FIG. 3], for example the coolant circuit 26 supplies cooling fluid first of all to the second cooling heat exchanger 5 and then to the first cooling heat exchanger 8 (the qualifiers "first" and "second" referring to the first and second compression stages in the direction of circulation of the working fluid).

Of course, the opposite arrangement may be envisioned (circulation of the cooling fluid first of all in the first heat exchanger 4 and then in the second heat exchanger 5).

As illustrated, in both cases, the directions of circulation of the two fluids (working fluid to be cooled and relatively colder cooling fluid) pass preferably in countercurrent or in opposite directions through each exchanger.

As illustrated in [FIG. 3], the fluidic connection between the two cooling heat exchangers 4, 5 for the passage of the cooling fluid may be simplified and smaller. This transfer of cooling fluid from one cooling exchanger 4, 5 to the other may in particular be realized by a short and welded portion of tube, or a simple tube or connector between the two heat exchangers 4, 5.

As mentioned above, the two cooling heat exchangers 4, 5 may in particular be disposed adjacently, in particular alongside one another. This optimizes the space requirement of the device.

If necessary, the two cooling heat exchangers 4, 5 could even be incorporated in one and the same casing or housing comprising two separate passages for the circulation of the working fluid, said two passages being in heat exchange respectively with two portions in series of one and the same circulation channel of the cooling fluid circuit. For example, the cooling heat exchangers 4, 5 may each have an elongate shape extending in a respective longitudinal direction. Each cooling heat exchanger 4, 5 comprises an inlet for working gas to be cooled and an outlet for cooled working gas that are disposed respectively at two longitudinal ends.

The cooling heat exchangers 4, 5 may be exchangers of the tube type, of the shell and tube type, of the plate type or any other appropriate technology. The exchangers 4, 5 may be made of aluminum and/or stainless steel.

Moreover, the two cooling heat exchangers 4, 5 are arranged within the device preferably inversely with respect to one another, meaning that the respective longitudinal directions of the two cooling heat exchangers 4, 5 are parallel or substantially parallel and the directions of circulation of the working fluid in said cooling heat exchangers 4, 5 are opposite to one another. This arrangement combined with the arrangement of the circulation of the cooling fluid makes it possible to minimize the complexity of the fluidic circuits while conferring very good performance on the device.

All or part of the device, in particular the cold members thereof, can be accommodated in a thermally insulated sealed casing 11 (in particular a vacuum chamber containing the common countercurrent heat exchanger and the refrigeration exchanger 8).

The invention may apply to a method for cooling and/or liquefying another fluid or mixture, in particular hydrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A low-temperature refrigeration device for refrigeration at a temperature of between minus 100 degrees centigrade and minus 273 degrees centigrade, the device being disposed in a frame and comprising:

a working circuit forming a loop and containing a working fluid, the working circuit forming a cycle that comprises, in series: a compression mechanism for compressing the working fluid, a cooling mechanism for cooling the working fluid, an expansion mechanism for expanding the working fluid, and a heating mechanism for heating the working fluid, wherein:

the compression mechanism comprises at least two compressors and at least one drive motor for the compressors, the expansion mechanism comprises at least one rotary turbine, each of said at least one drive motor comprises a drive shaft, one end of which drives an associated one of the at least two compressors and another end of which is coupled to an associated one of the at least one rotary turbine, the cooling and heating mechanisms comprise a common heat exchanger through which the working fluid passes in countercurrent in two separate passage portions of the working circuit depending on whether the working fluid is being cooled or being heated, said motor is fixed to the frame at at least one fixed point, the common heat exchanger is fixed to the frame at at least one fixed point via a connection, the two countercurrent passage portions of the common heat exchanger are oriented in a longitudinal direction of the frame, the drive shaft of said drive motor is oriented in a direction parallel or substantially parallel to the longitudinal direction, the turbine and the compressor are arranged longitudinally relative to one another such that the turbine is situated longitudinally on a side corresponding to a relatively cold end of the common heat exchanger when the device is in operation and the compressor is situated longitudinally on a side corresponding to a relatively hot end of the common heat exchanger when the device is in operation, the connection to which the common heat exchanger is fixed to the frame at at least one fixed point is situated at a longitudinal position of the heat exchanger that is situated between the side corresponding to the relatively hot end of the common heat exchanger, which is likely to expand during operation of the device, and the side corresponding to the relatively cold end of the common heat exchanger, which is likely to contract during operation of the device; and a refrigeration heat exchanger intended to extract heat at at least one member by heat exchange with the working fluid circulating in the working circuit.

2. The device of claim 1, wherein:

when the device is in operation, a temperature of the common heat exchanger varies longitudinally between a cold end and a hot end, the cold end receiving the relatively cold working fluid coming from the expansion mechanism in order to heat it and evacuating the cooled working fluid before it enters the expansion mechanism, the hot end receiving the hot working fluid coming from the compression mechanism and evacuating the heated working fluid before it enters the compression mechanism; and the connection to which the common heat exchanger is fixed to the frame at at least one fixed point is situated at an intermediate longitudinal position of the heat exchanger between the cold and hot ends thereof in a zone at an operating temperature of between 200 and 270 K.

3. The device of claim 2, where the cold end is at a temperature of about 100K and the hot end is at a temperature of about 300K.

4. The device of claim 1, wherein the fixed point, to which said motor is fixed to the frame at at least one fixed point, and the fixed point, to which the common heat exchanger is fixed to the frame at at least one fixed point, are spaced apart in the longitudinal direction by a distance less than 100 cm.

5. The device of claim 4, wherein the fixed point, to which said motor is fixed to the frame at at least one fixed point, and the fixed point, to which the common heat exchanger is fixed to the frame at at least one fixed point, are spaced apart in the longitudinal direction by a distance less than 10 cm.

6. The device of claim 4, wherein the fixed point, to which said motor is fixed to the frame at at least one fixed point, and the fixed point, to which the common heat exchanger is fixed to the frame at at least one fixed point, are situated at a same level in the longitudinal direction of the frame.

7. The device of claim 1, wherein:

the cooling mechanism comprises two cooling heat exchangers that are disposed at respective outlets of the two compressors and ensure heat exchange between the working fluid and a cooling fluid;

the frame comprises a lower base intended to be fixed to a support; and the two cooling heat exchangers are situated in the frame next to the common heat exchanger in a direction transverse to the longitudinal axis such that the cooling heat exchangers are not situated between the common heat exchanger and the lower base of the frame.

8. The device of claim 7, wherein the two cooling heat exchangers each have an elongate shape extending in respective longitudinal directions that are parallel to the longitudinal axis.

9. The device of claim 7, wherein the two cooling heat exchangers are disposed one above the other.

10. The device of claim 7, wherein:

each cooling heat exchanger comprises an inlet for working gas to be cooled and an outlet for cooled working gas that are disposed respectively at two longitudinal ends;

each cooling heat exchanger comprises an inlet for cooling fluid and an outlet for cooling fluid;

the two cooling heat exchangers are arranged inversely with respect to one another such that the respective longitudinal directions of the two cooling heat exchangers are parallel or substantially parallel and the directions of circulation of the working fluid in said cooling heat exchangers are opposite to one another.

11. The device of claim 9, wherein the outlet for cooling fluid of one of the two cooling heat exchangers is connected to the inlet for cooling fluid of the other cooling heat exchanger such that some of the flow of cooling fluid passing through one of the cooling heat exchangers has already circulated in the other cooling heat exchanger.

12. The device of claim 7, wherein the two cooling heat exchangers are situated adjacently and spaced apart by a distance of between 0 and 500 mm.

13. The device of claim 12, wherein the two cooling heat exchangers are situated adjacently and spaced apart by a distance of between 10 and 300 mm.

14. A system for refrigeration and/or liquefaction of a flow of user fluid, in particular natural gas, comprising the refrigeration device of claim 1, at least one tank of user fluid, and a duct for circulation of said flow of user fluid in the cooling exchanger.

* * * * *